US011034562B2

(12) United States Patent
Armfield

(10) Patent No.: US 11,034,562 B2
(45) Date of Patent: Jun. 15, 2021

(54) MODULAR POWERED HOIST WITH INTEGRATED LIFT/GUIDE ASSEMBLY

(71) Applicant: Jeffrey S. Armfield, Grand Blanc, MI (US)

(72) Inventor: Jeffrey S. Armfield, Grand Blanc, MI (US)

( * ) Notice: Subject to any disclaimer, the term of this patent is extended or adjusted under 35 U.S.C. 154(b) by 0 days.

(21) Appl. No.: 16/600,274

(22) Filed: Oct. 11, 2019

(65) Prior Publication Data

US 2020/0115199 A1 Apr. 16, 2020

Related U.S. Application Data

(60) Provisional application No. 62/744,280, filed on Oct. 11, 2018.

(51) Int. Cl.

| | |
|---|---|
| ***B66D 3/18*** | (2006.01) |
| ***B66D 1/22*** | (2006.01) |
| ***B66D 1/12*** | (2006.01) |
| *B66D 3/26* | (2006.01) |

(52) U.S. Cl.

CPC ..... *B66D 3/18* (2013.01); *B66D 1/12* (2013.01); *B66D 1/22* (2013.01); *B66D 3/26* (2013.01)

(58) Field of Classification Search

CPC ..... B66D 3/12; B66D 3/18; B66D 3/20; B66D 3/26; B66D 1/12; B66D 1/22

See application file for complete search history.

(56) References Cited

U.S. PATENT DOCUMENTS

| | | | | | |
|---|---|---|---|---|---|
| 1,684,185 | A * | 9/1928 | Kittredge | B66D 3/16 | 254/344 |
| 3,883,119 | A | 5/1975 | Hansson | | |
| 4,227,680 | A * | 10/1980 | Hrescak | B66D 1/22 | 254/344 |
| 4,448,397 | A | 5/1984 | Broyden | | |
| 4,502,667 | A * | 3/1985 | Nakamura | B66D 1/58 | 192/48.3 |
| 4,545,567 | A * | 10/1985 | Telford | B66D 5/20 | 188/337 |
| 4,736,929 | A * | 4/1988 | McMorris | B66D 1/22 | 254/323 |
| 5,816,564 | A | 10/1998 | Winter | | |
| 7,000,904 | B2 * | 2/2006 | Huang | B66D 1/22 | 254/323 |

(Continued)

FOREIGN PATENT DOCUMENTS

| | | | |
|---|---|---|---|
| CN | 2084925 | U | 9/1991 |
| CN | 204643676 | U | 9/2015 |

*Primary Examiner* — Sang K Kim
*Assistant Examiner* — Nathaniel L Adams

(57) ABSTRACT

A modular powered hoist design comprises: 1) a multifunctional baseplate, which forms a foundation of the powered hoist design and comprises part of a guide system for a lifting media, and 2) an integrated lift/guide assembly, securing a liftwheel therein, that is attachable to the baseplate through attachment features formed within the baseplate. Embodiments allow for different components of a powered hoist to be interchanged in the case of material incompatibility or to provide higher guide performance (such as accommodating different safety factors). Moreover, in manufacturing, embodiments allow for the use of overlapping product parts across different powered hoist product designs, thereby reducing overhead-related costs.

20 Claims, 8 Drawing Sheets

(56) References Cited

U.S. PATENT DOCUMENTS

| | | | | |
|---|---|---|---|---|
| 7,080,825 | B1 | 7/2006 | George et al. | |
| 7,374,153 | B2 * | 5/2008 | Huang | B66D 5/02 254/267 |
| 7,717,193 | B2 | 5/2010 | Egilsson et al. | |
| 8,313,090 | B2 | 11/2012 | Kempf | |
| 8,763,992 | B2 | 7/2014 | Imbusch et al. | |
| 8,789,812 | B2 | 7/2014 | Imbusch et al. | |
| 8,789,813 | B2 | 7/2014 | Imbusch et al. | |
| 2008/0078980 | A1 * | 4/2008 | Aho | B66D 1/22 254/344 |
| 2016/0347593 | A1 | 12/2016 | Golder | |
| 2017/0183205 | A1 | 6/2017 | Figoureux | |
| 2018/0346297 | A1 | 12/2018 | Schmidt et al. | |
| 2020/0115198 | A1 | 4/2020 | Armfield | |

* cited by examiner

MODULAR POWERED HOIST WITH INTEGRATED LIFT/GUIDE ASSEMBLY

CROSS-REFERENCE TO RELATED APPLICATIONS

This application claims priority to U.S. Provisional Patent Application Ser. No. 62/744,280, filed Oct. 11, 2018 and entitled "Modular Lifting Device," the entirety of which is incorporated by reference herein.

BACKGROUND

Powered hoists are widely used in the materials handling industry and are used for moving large objects by means of a drum or liftwheel around which a lifting media (such as a wire rope, a chain, or a synthetic strap or rope) wraps. For example, powered hoists generally comprise a motor attached to the liftwheel that engages with the lifting media to lift or lower a hook or tool attached to or connected to the load. A liftwheel can be connected to a stationary structure capable of supporting loads attached to a powered hoist. A motor of a powered hoist may be driven by electricity, air, or hydraulic means. Air or hydraulic drive motors are typically controlled by valves which may be manual or electrical in operation to achieve the proper rotation to move a connected load up or down. An electric motor, where used, may be controlled by conventional electromechanical means or by digital control systems to achieve the proper rotation to move a connected load up or down.

Conventionally, powered hoists have been designed to take advantage of high-volume manufacturing techniques such as casting and/or forging where piece prices can be held to a minimum value. One disadvantage of using high-volume techniques is a lack of flexibility in changing product design. Efforts to modify an existing design of a powered hoist that uses these high volume manufacturing techniques for a new application requires significant time and financial resources.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Embodiments described herein are directed to an improved, modular powered hoist design comprising: 1) a multifunctional baseplate, which forms a foundation of the powered hoist design and comprises part of a guide system for a lifting media, and 2) an integrated lift/guide assembly, securing a liftwheel therein, that is attachable to the baseplate through attachment features formed within the baseplate. Embodiments described herein allow for different components of a powered hoist to be selected to optimize different and often conflicting operating parameters such as hoist safety factor, lifting media speed, and overall hoist weight in combinations not attainable in conventional designs. Moreover, in manufacturing, embodiments described herein allow for the use of overlapping product parts across different powered hoist product designs—thereby reducing overhead-related costs.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form a part of the specification, illustrate embodiments and, together with the description, further serve to explain the principles of the embodiments and to enable a person skilled in the pertinent art to make and use the embodiments.

Figure 1:
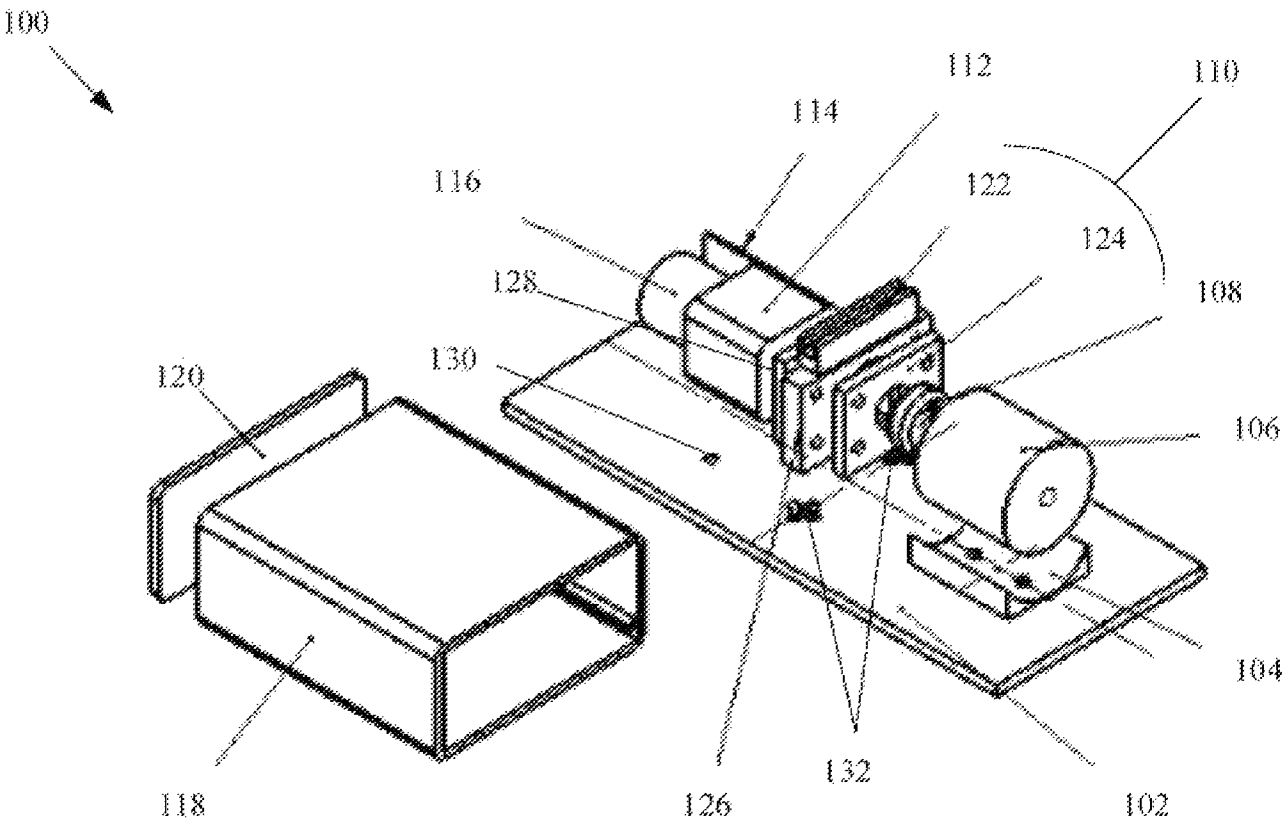
FIG. 1 is a top-side perspective view of a powered hoist in accordance with an embodiment.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION

I. Introduction

The present specification and accompanying drawings disclose one or more embodiments that incorporate the features of the present invention. The scope of the present invention is not limited to the disclosed embodiments. The disclosed embodiments merely exemplify the present invention, and modified versions of the disclosed embodiments are also encompassed by the present invention. Embodiments of the present invention are defined by the claims appended hereto.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

In the discussion, unless otherwise stated, adjectives such as "substantially," "approximately," and "about" modifying a condition or relationship characteristic of a feature or features of an embodiment of the disclosure, are understood to mean that the condition or characteristic is defined to be within tolerances that are acceptable for operation of the embodiment for an application for which it is intended.

Furthermore, it should be understood that spatial descriptions (e.g., "above," "below," "up," "left," "right," "down," "top," "bottom," "vertical," "horizontal," etc.) used herein are for purposes of illustration only, and that practical implementations of the structures described herein can be spatially arranged in any orientation or manner.

Still further, it should be noted that the drawings/figures are not drawn to scale unless otherwise noted herein.

Numerous exemplary embodiments are described as follows. It is noted that any section/subsection headings provided herein are not intended to be limiting. Embodiments are described throughout this document, and any type of embodiment may be included under any section/subsection. Furthermore, embodiments disclosed in any section/subsection may be combined with any other embodiments described in the same section/subsection and/or a different section/subsection in any manner.

Powered hoists are widely used in the materials handling industry and are used for moving large objects by means of a drum or liftwheel around which a lifting media (such as a wire rope, a chain, or a synthetic strap or rope) wraps. For example, powered hoists generally comprise a motor attached to the liftwheel that engages with the lifting media to lift or lower a hook or tool attached to or connected to the load. A liftwheel can be connected to a stationary structure capable of supporting loads attached to a powered hoist. A motor of a powered hoist may be driven by electricity, air, or hydraulic means. Air or hydraulic drive motors are typically controlled by valves which may be manual or electrical in operation to achieve the proper rotation to move a connected load up or down. An electric motor, where used, may be controlled by conventional electromechanical means or by digital control systems to achieve the proper rotation to move a connected load up or down.

Conventionally, powered hoists have been designed to take advantage of high-volume manufacturing techniques such as casting and forging where piece prices can be held to a minimum value. One disadvantage of using high-volume techniques is a lack of flexibility in changing product design. Efforts to modify an existing design of a powered hoist for a new application requires significant time and financial resources. With an alternative design methodology, digital fabrication techniques and additive manufacturing techniques can be leveraged to provide for greater product application flexibility. For example, embodiments described herein are directed to an improved, modular powered hoist design comprising: 1) a multifunctional baseplate, which forms a foundation of the powered hoist design and comprises part of a guide system for a lifting media, and 2) an integrated lift/guide assembly, securing a liftwheel therein, that is attachable to the baseplate through attachment features formed within the baseplate. Embodiments described herein allow for different components of a powered hoist to be selected to optimize different and often conflicting operating parameters such as hoist safety factor, lifting media speed, and overall hoist weight in combinations not attainable in conventional designs. Moreover, in manufacturing, embodiments described herein allow for the use of overlapping product parts across different powered hoist product designs—thereby reducing overhead-related costs.

FIG. 1 illustrates a perspective view of an exemplary embodiment of the improved, modular powered hoist design referenced above. FIG. 1 provides a top-side perspective view of a powered hoist 100, in accordance with embodiments described herein. As shown in FIG. 1, powered hoist 100 includes the following components or parts: a baseplate 102, a motor 106, a clutch 108, an integrated lift/guide assembly 110 (also referred to herein as a lifting block assembly), a gearbox 112, an electrical board 114, and a brake 116.

In FIG. 1, baseplate 102 assumes a rectangular structure. However, in other embodiments, baseplate 102 may assume any shape (e.g., a square, a triangle, or an oval). In embodiments, baseplate 102 comprises a mounting surface to which components of powered hoist 100 are attached that is substantially planar (i.e., a structure that is substantially longer and wider than thick) and substantially level (i.e., having minimal height differences between any given points on a surface).

Baseplate 102 is designed to accommodate one or more components of powered hoist 100 being mounted to or attached to its top surface via attachments features (e.g., a hole, recess or a slot). For example, during the assembly of powered hoist 100, integrated lift/guide assembly 110 may be mounted or attached to baseplate 102 via one or more attachment features 130, which in this embodiment comprises at least one aperture formed within baseplate 102. Further, integrated lift/guide assembly 110 may be attached to baseplate 102 via attachment feature(s) 130 using fasteners, such as bolts and nuts (e.g., a swage nut) or screws. Although in FIG. 1 only attachment feature 130 is visible, in this embodiment and other embodiments described herein, baseplate 102 may include any number of attachment features 130.

Baseplate 102 is further designed for guiding a lifting media (not pictured in FIG. 1 but shown in FIGS. 2 and 3) when powered hoist 100 is active. For example, baseplate 102 includes lifting media channels 132 formed within baseplate 102 and sized to keep a lifting media aligned with a liftwheel when the lifting media is lifted or lowered. To help further illustrate, during operation of powered hoist 100, a lifting media may move through a first channel of lifting media channels 132 in a first direction and move through a second channel of lifting media channels 132 in a second direction opposite the first direction. Lifting media channels 132 can be modified for improved performance with certain parent materials by the applications of certain coatings which increase surface hardness and lubricity.

Also shown in FIG. 1, integrated lift/guide assembly 110 includes: an upper hook or lug mount 122, a lifting media guide 126, and side plates 124 and 128. As depicted in FIG. 1, upper hook or lug mount 122 is affixed to lifting media guide 126 and side plates 124 and 128 are affixed to opposing sides of lifting media guide 126. In another embodiment, upper hook or lug mount 122 may be affixed to lifting media guide 126 and to one or both of side plates 124 and 128 (as illustrated in subsequent FIGS. 2 and 3). In embodiments, upper hook or lug mount 122, lifting media guide 126, and side plates 124 and 128 may be affixed to each other using fasteners (e.g., bolts, screws, etc.) or via another attachment means.

As previously described, integrated lift/guide assembly 110 may be mounted to baseplate 102 via attachment feature(s) 130. In an embodiment, only lifting media guide 126 of integrated lift/guide assembly 110 may be attached to baseplate 102 via attachment feature(s) 130. In another embodiment, lifting media guide 126 and one or more of side plates 124 and 128 may be attached to baseplate 102 via attachment features of baseplate 102 (shown in FIGS. 2 and 3).

Integrated lift/guide assembly 110 (together with baseplate 102) forms a guide system for a lifting media when the lifting media is lifted or lowered during operation of powered hoist 100. For example, lifting media guide 126 is operable to guide a lifting media around a liftwheel (not visible in FIG. 1 but shown in FIG. 4) secured within lifting media guide 126 as the liftwheel turns. Side plates 124 and 128 are operable to secure a liftwheel within lifting media guide 126, Upper hook or lug mount 122 is operable to connect powered hoist 100 to a structural support capable of supporting powered hoist 100 as well as loads attached to lifting media thereof. For example, upper hook or lug mount 122 may comprise a conventional hook mount or a lug mount (e.g., in a trolley system) that can be used to suspend powered hoist 100 overhead to a support beam of a building or structure.

Additionally, in FIG. 1, a mount 104 is shown attached to baseplate 102. In an embodiment, mount 104 may comprise a pedestal mount. Mount 104 may be used to attach motor 106 to baseplate 102. Mount 104 may be affixed to baseplate 102 via one or more attachment features (like attachment feature 130) using fasteners (e.g., bolts and nuts, screws, etc.). Motor 106 may be attached to mount 104 in a similar manner as mount 104 is attached to baseplate 102 or may merely be cradled in mount 104 without the use of fasteners. In another embodiment, motor 106 may be attached directly to baseplate 102. Moreover, motor 106 can be an electrical, pneumatic, or hydraulic type motor and can assume a plurality of sizes. As such, baseplate 102 may be designed to accommodate several types of motors with differing motor geometries and sizes and requiring different mounting schemes—thus providing powered hoist 100 the flexibility to be used for a variety of applications.

In FIG. 1, motor 106 is connected to clutch 108. Clutch 108 may protect powered hoist 100 from over-winding or gross overload (e.g., at a certain torque clutch 108 will stop rotating). Clutch 108 may comprise a conventional friction clutch. Alternatively, clutch 108 may comprise another type of clutch, such as a clutch that involves electromagnetic or other emerging technologies, or can be entirely omitted depending on the application of the product. As further shown in FIG. 1, clutch 108 is additionally connected to integrated lift/guide assembly 110, integrated lift/guide assembly 110 is additionally connected to gearbox 112, and gearbox 112 is additionally connected to brake 116. Gearbox 112, integrated lift/guide assembly 110, clutch 108, motor 106 and brake 116 may be connected via shafts that are part of each respective component and/or may be individual components. Furthermore, in embodiments, these shafts may be of a conventional type connected by a spline or keyway or may include flexible shafting or intermediate, offset gear trains.

FIG. 1 shows a specific arrangement of components of powered hoist 100 attached to baseplate 102. Nonetheless, baseplate 102 is designed to accommodate various viable arrangements of components of powered hoist 100. For example, components of powered hoist 100 may be arranged on baseplate 102 such that motor 106 connects to an input of gearbox 112 and an output of gearbox 112 connects to the liftwheel secured in integrated lift/guide assembly 110.

Gearbox 112 may include two or more gears with one of the gears driven by power transmitted from motor 106 (e.g., via a shaft). In a particular embodiment, gearbox 112 may include a planetary design. Some advantages of planetary gearing include: high torque transmission, compact design relative to other gearing schemes, and high numerical gear ratios. Furthermore, a planetary gearbox allows changing of ratios of a gearbox by simply changing a gear arrangement inside the gearbox. This increases the range of applications for which powered hoist 100 can be used and allows for the same gearbox to be used in different product designs.

Brake 116, if applied during operation of powered hoist 100, will stop gearbox 112 which in turns stops movement of a liftwheel and movement of a lifting media engaged with the liftwheel. Brake 116 can be controlled by electric, pneumatic, or hydraulic means.

Also shown in FIG. 1, attached to baseplate 102 is electrical board 114 that is used to control powered hoist 100 (e.g., turn on/off motor 106, turn on/off brake 116, set speed of motor 106, etc.). Electrical board 114 may include controls that are electrical, hydraulic, or pneumatic in nature. In an embodiment, powered hoist 100 may include a variable frequency drive (in the form of an electrical board or boards) that is connected to baseplate 102, a connection harness that electrically connects motor 106, brake 116, and an operator pendant control to the variable frequency drive, and a dynamic braking resistor connected to the variable frequency drive. The variable frequency drive may comprise a type of adjustable-speed drive used to control AC motor speed and torque by varying motor input frequency and voltage. In addition, in this example embodiment, the dynamic braking resistor used to dissipate energy from the variable frequency drive may be attached directly to baseplate 102 to aid in heat dissipation, allowing baseplate 102 to act as a heatsink. In other embodiments, baseplate 102 may include additional features to aid in heat dissipation, such as pins or fins.

Components of powered hoist 100 may be enclosed for user protection and durability of powered hoist 100. For example, a cover may be connected to baseplate 102 and integrated lift/guide assembly 110 such that the cover substantially covers baseplate 102, motor 106, clutch 108, gearbox 112, brake 116, electric board 114, a liftwheel of integrated lift/guide assembly 110, and any shafts connecting components of powered hoist 100 and such that the cover partially covers a lifting media and integrated lift/guide assembly 110 (e.g., by exposing upper hook or lug mount 122). In an embodiment, the cover may comprise a first cover portion 118 (shown in FIG. 1) that engages with a first end of base plate 102 and a similarly designed second cover portion that engages with a second and opposing end of baseplate 102. For additional protection, a first end cap 120 may be attached to first cover portion 118 and a second end cap may be attached to the second cover portion. The components of the cover may can be made from one or more different materials (e.g., plastic, metal, etc.) dependent on the application. Additionally, each cover portion may employ geometry to interlock to baseplate 102, reinforcing structural integrity of powered hoist 100 while also protecting the components of powered hoist 100. In an alternative embodiment, additional design flexibility can be obtained by using flat sheets of a material to form a cover and end cap. For example, sheets of a material may be attached using a fastening system to form a cover and end cap. Each end cap, like the cover portions, may be made from one or more different materials (e.g., plastic, metal, etc.) and comprise different configurations (e.g., inclusion of handles to assist in portability).

Figure 2:
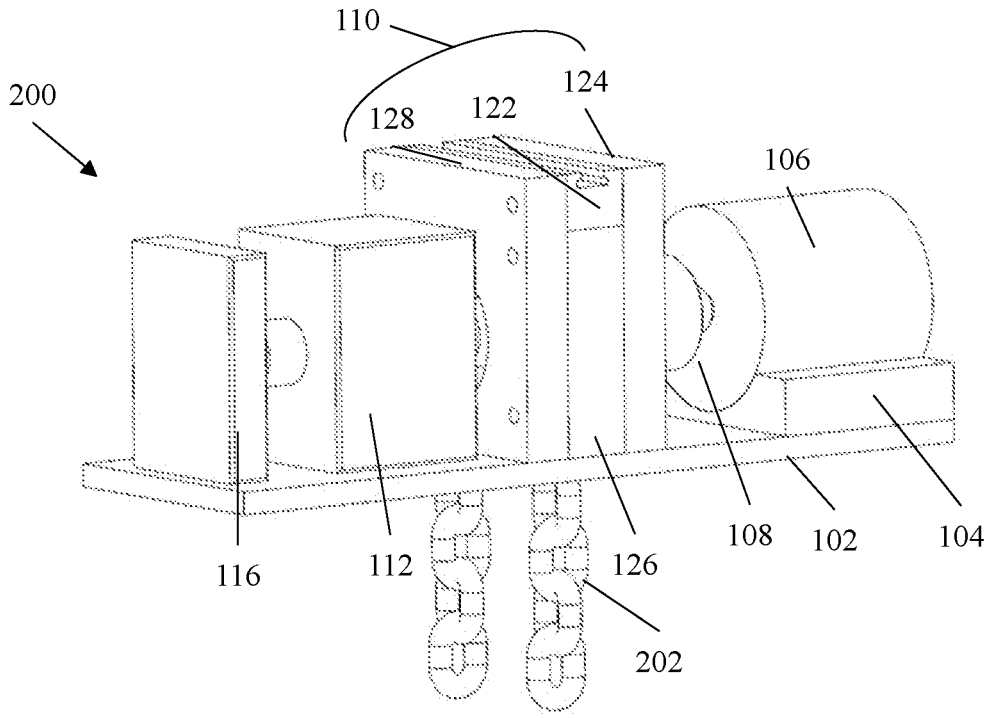
FIG. 2 is a top-side perspective view of a powered hoist in accordance with another embodiment.
Figure 3:
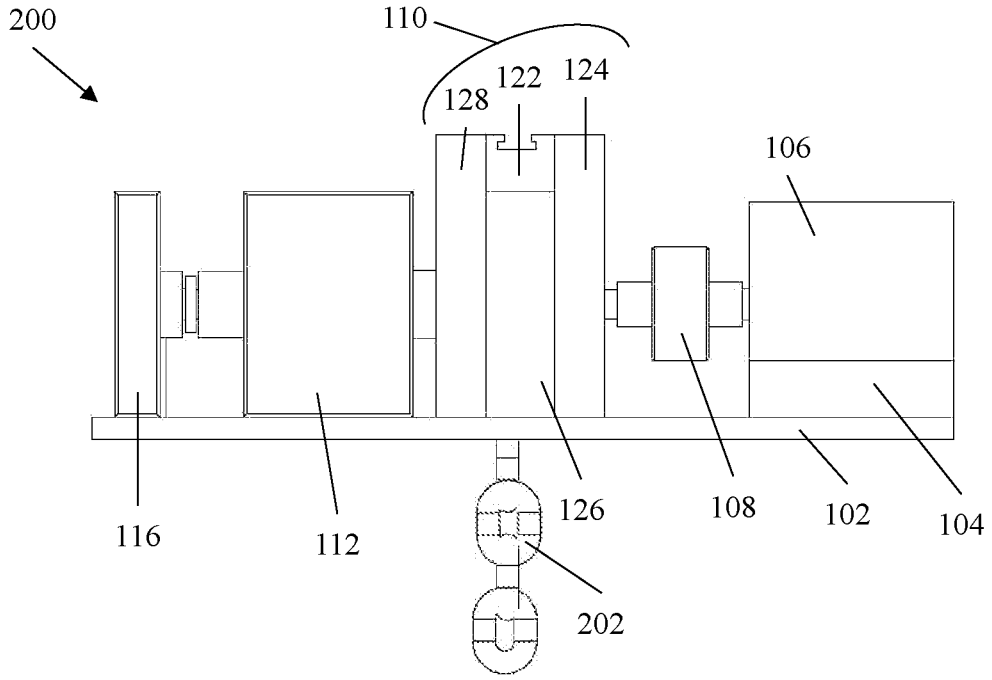
FIG. 3 is a side perspective view of the powered hoist of FIG. 2.

FIGS. 2 and 3 will now be described. FIGS. 2 and 3 provide different perspective views of another exemplary embodiment of powered hoist 100. FIG. 2 provides a top-side perspective view of a powered hoist 200, which includes the same components as powered hoist 100 but also includes a lifting media 202. Although lifting media 202 is depicted as a metal chain, lifting media 202 could also comprise any other type of chain, any type of rope, any type of wire, or any type of strap (e.g., a strap made of synthetic material). However, these examples are not intended to be limiting, and still other types of lifting media may be used. One end of lifting media 202 may be connected to a load hook.

Lifting media 202 is designed to engage with a liftwheel and be raised or lowered responsive to the turning of the liftwheel. For example, lifting media 202 may be wrapped around or aligned with a liftwheel secured within integrated lift/guide assembly 110. To help further illustrate, a portion of lifting media 202 may be moved through a first lifting media channel (e.g., lifting media channels 132 in FIG. 1) in baseplate 102 in an upward direction and another portion of lifting media 202 may be moved through a second lifting media channel in baseplate 102 in a downward direction to lift a load connected to lifting media 202.

FIG. 2 also depicts another configuration of integrated lift/guide assembly 110. In FIG. 2, integrated lift/guide assembly 110 includes: upper hook or lug mount 122, lifting media guide 126, and side plates 124 and 128. In contrast to FIG. 1, FIG. 2 shows upper hook or lug mount 122 affixed to lifting media guide 126 and side plates 124 and 128. FIG. 3 provides another perspective view of powered hoist 200. FIG. 3 is a side perspective view of powered hoist 200, in accordance with embodiments described herein.

Figure 4:
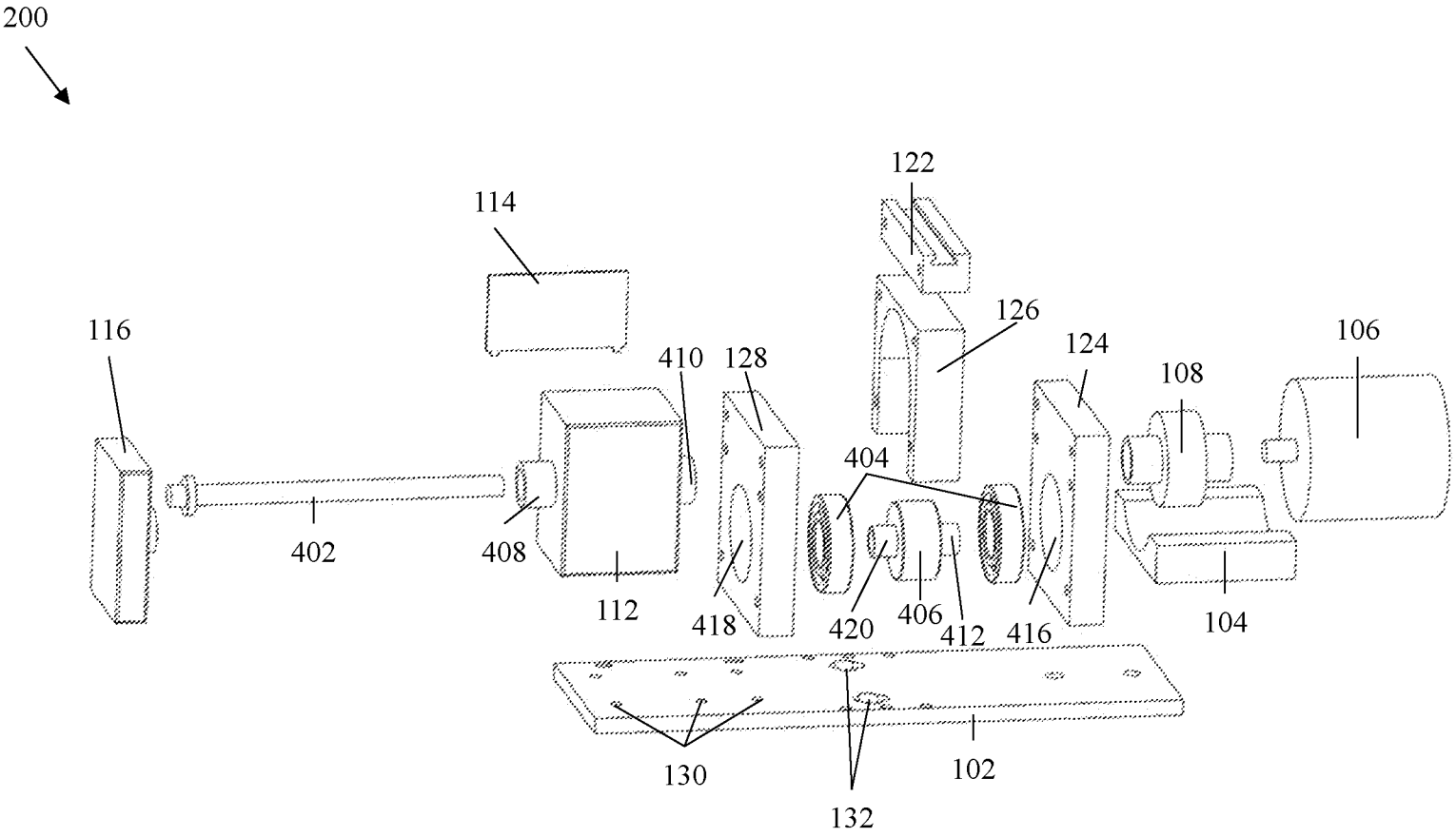
FIG. 4 is an exploded side perspective view of the powered hoist of FIG. 2.

To help further illustrate how components of powered hoists 100 and 200 are connected, FIG. 4 will now be described. FIG. 4 provides an exploded side perspective view of powered hoist 200, in accordance with embodiments described herein. As shown in FIG. 4, powered hoist 200 includes the following additional components not shown in FIGS. 2 and 3: a drive shaft 402, bearings 404, and a liftwheel 406.

Drive shaft 402 is designed to connect to clutch 108, gearbox 112, and brake 116. For example, as shown in FIG. 4, drive shaft 402 is substantially cylindrically shaped and sized to allow drive shaft 402 to pass from clutch 108 to gearbox 112 through a circular aperture 416 in side plate 124, an axial channel 412 that extends through an axle 420 of liftwheel 406, and a circular aperture 418 in side plate 128. Clutch 108 is operable to be rotated by motor 106 and drive shaft 402 is operable to be turned by the rotation of clutch 108. Drive shaft 402 is further designed to pass through gearbox 112 to connect to brake 116. Brake 116, if applied or engaged during operation of powered hoist 200, will stop the turning of drive shaft 402, thereby also stopping the operation of gearbox 112.

As further shown in FIG. 4, gearbox 112 includes a gearbox input 408 and a gearbox output 410. For example, gearbox input 408 connects to drive shaft 402 and is operable to be actuated by the turning of drive shaft 402. Gearbox output 410 connects to liftwheel 406 and is operable to be turned in responsive to the actuation of gearbox input 408. Gearbox 112 is configured to concentrate power from motor 106 to lift a load attached to a lifting media (e.g., lifting media 202 of FIGS. 2 and 3). For instance, an operator of powered hoist 200, through interaction with an operator pendant control attached to electrical board 114, may power on motor 106 to initiate a lifting of a load attached to a lifting media. After powering on, motor 106 may cause clutch 108 to rotate in a direction needed to lift the lifting media. The rotation of clutch 108 may then cause drive shaft 402 to turn. Gearbox input 408 may be actuated (e.g., by starting to rotate gears within gearbox 112) by the turning of drive shaft 402 and gearbox output 410 may turn liftwheel 406 in response to the actuation of gearbox input 408. The lifting media engaged with liftwheel 406 (e.g., using a sprocket and chain system) may then be lifted responsive to gearbox output 410 turning liftwheel 406. Gearbox output 410 reduces rotational speed and increases rotational torque to facilitate lifting of the load.

When powered hoist 200 is assembled, a first end of axle 420 of liftwheel 206 is disposed within circular aperture 416 in side plate 124 and a second end of axle 420 is disposed within circular aperture 418 in side plate 128. A first bearing of bearings 404 may be disposed between the first end of axle 420 and an edge of circular aperture 416 in side plate 124 and a second bearing of bearings 404 may be disposed between the second end of axle 420 and an edge of circular aperture 418 in side plate 128. Bearings 404 can be used to limit movement of components of powered hoist 200 to a desired motion and reduce friction between moving parts of powered hoist 200.

As further shown in FIG. 4, baseplate 102 includes attachment features 130. For example, as described with reference to FIG. 1, integrated lift/guide assembly 110 may be mounted or attached to baseplate 102 via one or more attachment features 130. Further, integrated lift/guide assembly 110 may be attach to baseplate 102 via attachment features 130 using fasteners, such as bolts and nuts or screws. Similarly, in some embodiments, brake 116 and gearbox 112 may be attached via attachment features 130 to baseplate 102. Different types of attachment features may be used for different components.

Figure 5:
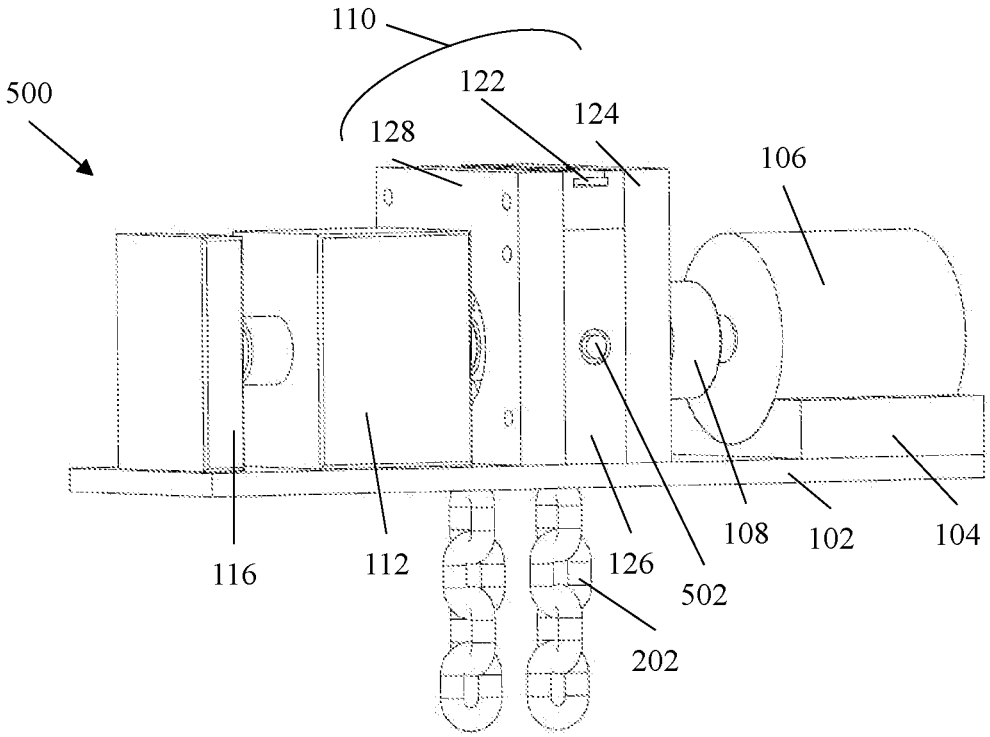
FIG. 5 is a top-side perspective view of a powered hoist in accordance with a further embodiment.

FIG. 5 provides a top-side perspective view of another exemplary powered hoist in accordance with an embodiment. FIG. 5 provides a top-side perspective view of a powered hoist 500, which includes the same components as powered hoist 100 and powered hoist 200 but also includes a position sensor 502 for providing positional feedback from the liftwheel. For example, as a liftwheel secured within integrated lift/guide assembly 110 rotates past position sensor 502, geometric features of the liftwheel relating to the rotational position of the liftwheel are reported (e.g., via an electrical signal) to a variable frequency drive or other monitoring device. In an embodiment, a liftwheel can be modified to create additional geometric features (such as "teeth") to increase positional detection accuracy. Position sensor 502 may employ either electromagnetic or optical principles to provide positioning feedback. Although position sensor 502 is shown placed on the side of lifting media guide 126, one or more position sensors may easily be placed in any number of other configurations on powered hoist 500 as specific lifting applications may require single or dual (redundant) positioning feedback.

Figure 6:
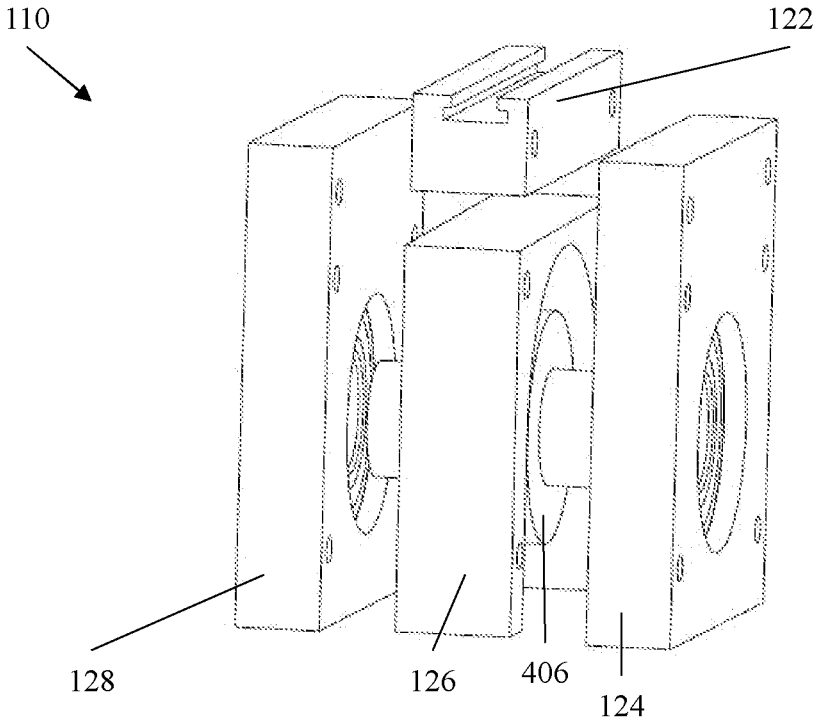
FIG. 6 is an exploded view of an integrated lift/guide assembly in accordance with an embodiment.

FIG. 6 provides an exploded view of integrated lift/guide assembly 110 including upper hook or lug mount 122, lifting media guide 126, and side plates 124 and 128. As shown in FIG. 6, with side plates 124 and 128 detached from lifting media guide 126, liftwheel 406 is exposed. Like in FIG. 4, a top portion of lifting media guide 126 is rounded and sized for accommodating liftwheel 406. This rounded cavity in the top portion of lifting media guide 126 may be designed to accommodate liftwheel 406 and a lifting media and keep liftwheel 406 and a lifting media aligned when powered hoist 100 and powered hoist 200 are operating. Furthermore, integrated lift/guide assembly 110 may be fabricated from any suitable, lightweight material(s), including plastic, rubber, metal, composites, or a combination of metals/alloys, etc. Alternatively, integrated lift/guide assembly 110 may be made from stronger materials including metals such as titanium or steel, composites such as fibre-reinforced plastic, or a combination of metals/alloys, etc.

Figure 7:
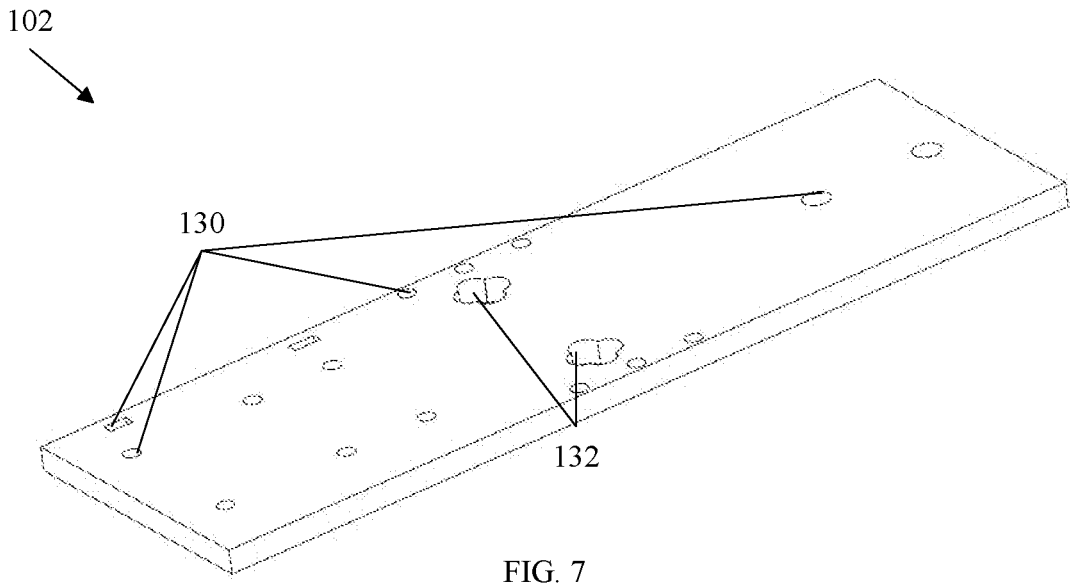
FIG. 7 is a perspective view of an exemplary baseplate of a powered hoist in accordance with an embodiment.
Figure 8:
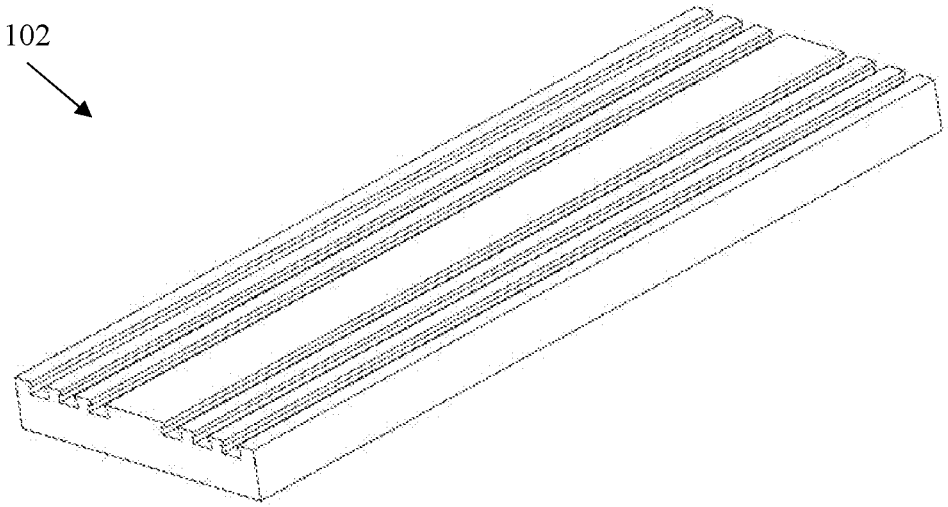
FIG. 8 is a perspective view of an exemplary baseplate of a powered hoist in accordance with an alternate embodiment.
Figure 9:
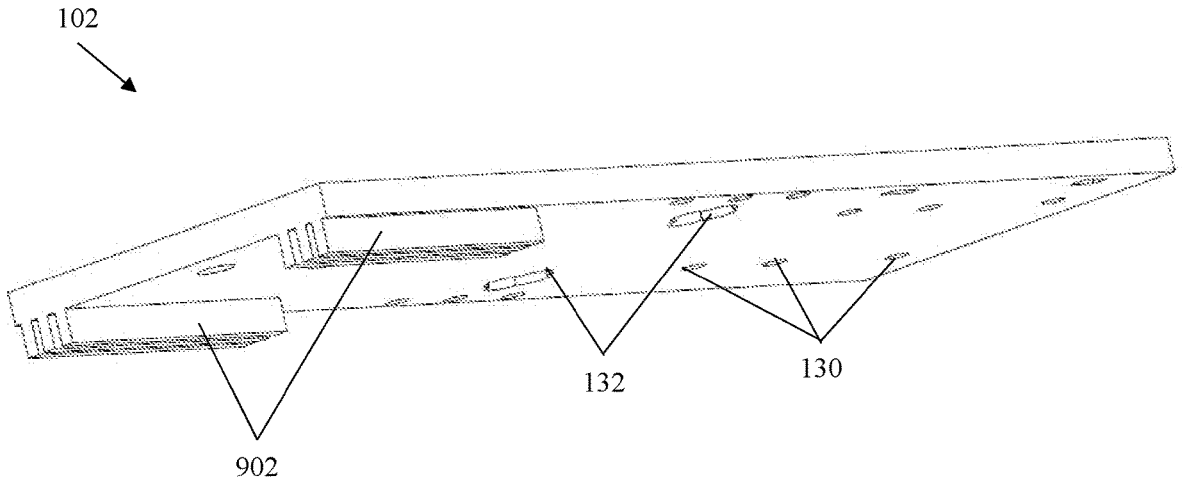
FIG. 9 is a perspective view of an exemplary baseplate of a powered hoist in accordance with an alternate embodiment.

FIGS. 7-9 provide exemplary embodiments of baseplate 102. In FIG. 7, baseplate 102 includes lifting media channels 132 and several attachment features 130 for mounting components of a powered hoist to baseplate 102. In some embodiments, baseplate 102 may include several attachment features assuming differently sized and/or differently shaped apertures formed within baseplate 102. Differently sized and/or differently shaped apertures may indicate where to attach particular components of powered hoist 100 powered hoist 200 on baseplate 102. For example, in FIG. 7, the square shaped apertures may indicate where to attach electric board 114 (referenced in prior FIGS.).

In other embodiments, components of powered hoist 100 and 200 may be attached to baseplate 102 via a snap locking system or via a slotted system. As shown in FIG. 8, components of powered hoist 100 and powered hoist 200 may be connected directly into slots of baseplate 102 or may be connected to the baseplate by intermediary connectors that fit into the slot and fasten to the components by other fastening means such as screws. Components of powered hoist 100 and 200 may also include attachment devices that allow components of powered hoist 100 and 200 to impermanently attach to baseplate 102. Furthermore, baseplate 102 may be fabricated from any suitable, lightweight material(s), including plastic, rubber, metal, composites, or a combination of metals/alloys, etc. Alternatively, baseplate 102 may be made from stronger material(s), including metals such as titanium or steel, composites such as fibre-reinforced plastic, or a combination of metals/alloys, etc.

As previously described, baseplate 102 may act as a heatsink and can include additional features to aid in heat dissipation, particularly when a dynamic braking resistor is connected directly to the mounting surface of baseplate 102. For example, FIG. 9 provides a bottom perspective view of baseplate 102 in accordance with an embodiment in which a bottom surface of baseplate 102 includes fins 902 extending therefrom. Fins 902 may be attached to baseplate 102 to further aid heat dissipation by providing an increased surface area over which heat may be distributed and dissipated. As previously noted, other structures (e.g., pins) may also be attached to or integrated with baseplate 102 in order to aid heat dissipation.

Figure 10:
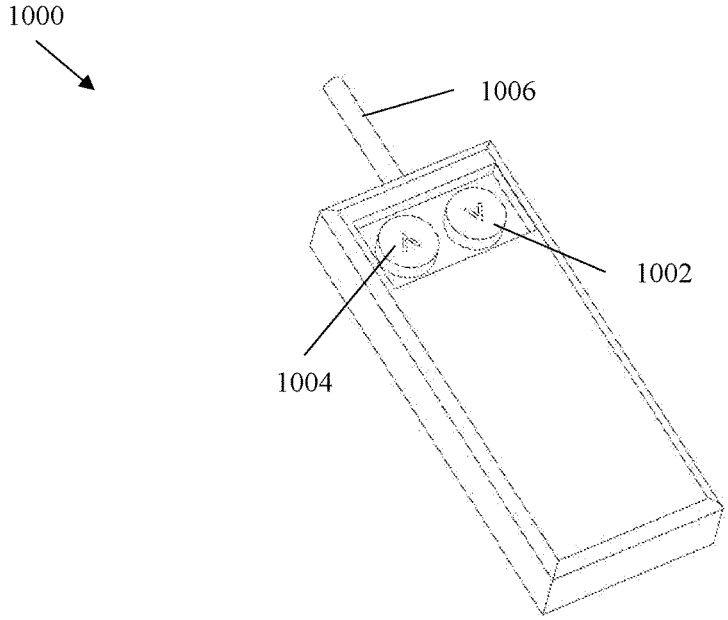
FIG. 10 is a perspective view of a pendant used to operate a powered hoist in accordance with an embodiment.

FIG. 10 will now be described. FIG. 10 provides an exemplary embodiment of a pendant configured to control powered hoist 100 of FIG. 1 and powered hoist 200 of FIGS. 2-4. In FIG. 10, a pendant 1000 connects to electrical board 114 of baseplate 102 through a connection harness 1006. Connection harness 1006 may include an assembly of electrical cables or wires which transmit signals or electrical power to electrical board 114 to control powered hoist 100 and powered hoist 200 (e.g., turn on/off motor 106, turn on/off brake 116, adjust speed of motor 106, etc.). These cables or wires may be bound together by a durable material such as rubber, vinyl, electrical tape, conduit, a weave of extruded string, or a combination thereof.

An operator may use buttons 1004 and 1002 to operate powered hoist 100 or powered hoist 200. For example, an operator may push button 1004 to activate the powered hoist and cause the powered hoist to lift a load attached to a lifting media. In addition, the operator may push button 1002 to activate the powered hoist and cause the powered hoist to lower a load attached to a lifting media.

Figure 11:
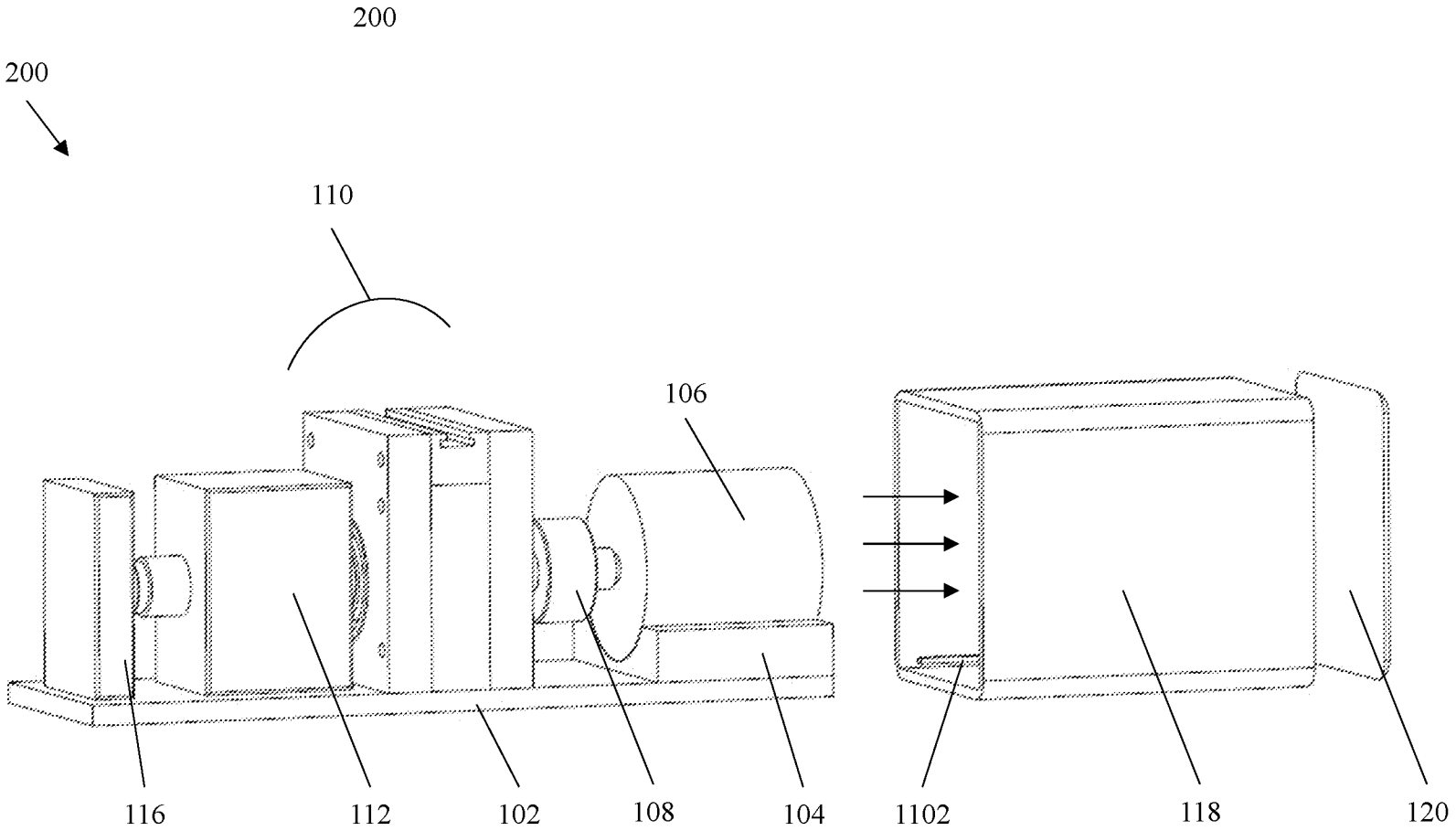
FIG. 11 is a top-side perspective view of the powered hoist of FIG. 2.

FIG. 11 provides another exemplary embodiment of powered hoist 200 illustrated in FIGS. 2-4. FIG. 11 shows cover 118 and end cap 120 that are designed to enclose powered hoist 200 for user protection and durability of powered hoist 200. For example, cover 118 may be connected to baseplate 102 such that cover 118 substantially covers baseplate 102, motor 106, clutch 108, gearbox 112, brake 116, and electric board 114, and such that cover 118 partially covers integrated lift/guide assembly 110 and a lifting media. For additional protection, end cap 120 may be attached to a first end of cover 118 and a second end cap, like end cap 120, may be attached to a second end of cover 118 opposite the first end of cover 118. Additionally, cover 118 may employ geometry to interlock to baseplate 102, reinforcing structural integrity of powered hoist 200 while also protecting the components of powered hoist 200. For example, in FIG. 11, cover 118 includes a slot 1102 which may allow for baseplate 102 to be inserted into cover 118 and secured within cover 118. In one embodiment, an additional slot, like slot 1102, may be positioned directly across from slot 1102 on an opposite side of cover 118. Further, baseplate 102 may include features located on each side of baseplate 102 adjacent to the mounting surface of baseplate 102 that interlock with slot 1102 and the other slot when baseplate 102 is inserted. Still other structures for interlocking baseplate 102 to cover 118 may be utilized.

Figure 12:
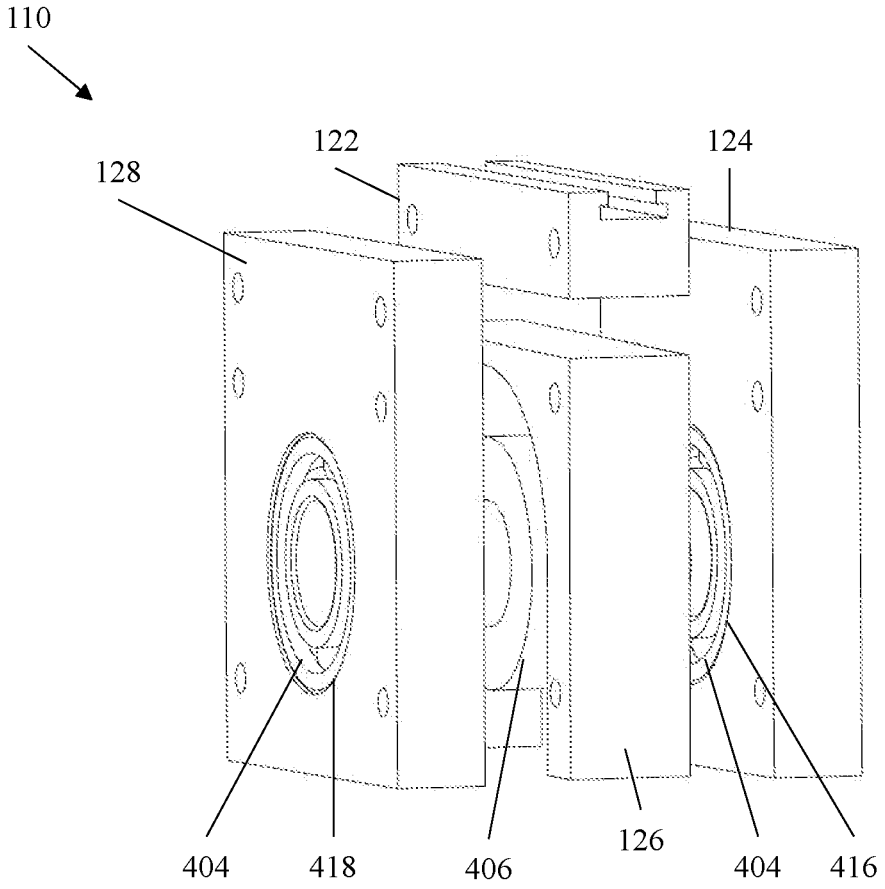
FIG. 12 is an exploded view of an integrated lift/guide assembly in accordance with an alternate embodiment.

FIG. 12 provides another exploded view of an exemplary embodiment of integrated lift/guide assembly 110. As shown in FIG. 12, integrated lift/guide assembly 110 includes upper hook or lug mount 122, lifting media guide 126, and side plates 124 and 128. In FIG. 12, with side plates 124 and 128 detached from lifting media guide 126, liftwheel 406 is exposed. Like shown in FIGS. 4 and 6, a top portion of lifting media guide 126 is rounded and sized for accommodating liftwheel 406. This rounded cavity in the top portion of lifting media guide 126 may be designed to accommodate liftwheel 406 and a lifting media and keep liftwheel 406 and a lifting media aligned when powered hoist 100 and powered hoist 200 are operating.

When powered hoist 200 is assembled, a first end of an axle of liftwheel 406 is disposed within circular aperture 416 in side plate 124 and a second end of an axle is disposed within circular aperture 418 in side plate 128. As shown in FIG. 12, a first bearing of bearings 404 may be disposed between the first end of the axle and an edge of circular aperture 416 in side plate 124 and a second bearing of bearings 404 may be disposed between the second end of the axle and an edge of circular aperture 418 in side plate 128. Bearings 404 can be used to limit movement of components of powered hoist 200 to a desired motion and reduce friction between moving parts of powered hoist 200.

Upper hook or lug mount 122 may be affixed to lifting media guide 126 and to one or both of side plates 124 and 128 (as illustrated in FIGS. 2 and 3). Upper hook or lug mount 122, lifting media guide 126, and side plates 124 and 128 may be affixed to each other using fasteners (e.g., bolts, screws, etc.) or via another attachment means.

VI. Conclusion

While various embodiments have been described above, it should be understood that they have been presented by way of example only, and not limitation. It will be apparent to persons skilled in the relevant art that various changes in form and detail can be made therein without departing from the spirit and scope of the embodiments. Thus, the breadth and scope of the embodiments should not be limited by any of the above-described exemplary embodiments, but should be defined only in accordance with the following claims and their equivalents.

What is claimed is:

1. A powered hoist, comprising:

a baseplate;

a motor connected to the baseplate;

a clutch connected to the motor and operable to be rotated thereby;

a drive shaft connected to the clutch and operable to be turned by the rotation thereof;

a gearbox having a gearbox input and a gearbox output, the gearbox input being connected to the drive shaft and actuated by the turning thereof;

a liftwheel connected to the gearbox output and operable to be turned thereby responsive to the actuation of the gearbox input;

a lifting media engaged with the liftwheel and operable to be raised or lowered thereby responsive to the turning of the liftwheel; and an integrated lift/guide assembly comprising:

a lifting media guide that is connected to the baseplate and that is operable to guide the lifting media around the liftwheel as it turns, the liftwheel being inside the lifting media guide;

first and second side plates affixed to opposing sides of the lifting media guide and operable to secure the liftwheel within the lifting media guide; and an upper hook or lug mount that is directly connected to the lifting media guide, indirectly connected to the first side plate and the second side plate via at least the lifting media guide, and operable to connect the powered hoist to a structural support;

wherein the drive shaft passes from the clutch to the gearbox through an aperture in the first side plate, an axial channel of the liftwheel, and an aperture in the second side plate.

2. The powered hoist of claim 1, wherein the aperture in the first side plate and the aperture in the second side plate comprise circular apertures, and wherein a first end of an axle of the liftwheel is disposed within the circular aperture in the first side plate, a second end of the axle of the liftwheel is disposed within the circular aperture in the second side plate, and bearings are disposed between the first end of the axle of the liftwheel and an edge of the circular aperture in the first side plate and between the second end of the axle of the liftwheel and an edge of the circular aperture in the second side plate.

3. The powered hoist of claim 1, wherein:

the baseplate comprises a substantially planar mounting surface having a motor attachment feature and an integrated lift/guide assembly mounting feature formed therein;

the motor is connected to the mounting surface via the motor attachment feature; and the integrated lift/guide assembly is connected to the mounting surface via the integrated lift/guide assembly mounting feature.

4. The powered hoist of claim 3, wherein at least one of the motor attachment feature and the integrated lift/guide assembly mounting feature comprises a hole, a recess or a slot.

5. The powered hoist of claim 3, wherein the motor is connected to a mount that is connected to the mounting surface via the motor attachment feature.

6. The powered hoist of claim 1, wherein the lifting media comprises one of a chain, a rope, a wire, or a strap.

7. The powered hoist of claim 1, wherein the baseplate comprises a first lifting media channel and a second lifting media channel each of which allows the lifting media to pass through the baseplate as the lifting media is raised or lowered.

8. The powered hoist of claim 1, further comprising a brake connected to the drive shaft and operable to stop the turning of the drive shaft when engaged.

9. The powered hoist of claim 8, wherein the brake is one of electrically-controlled, pneumatically-controlled or hydraulically controlled.

10. The powered hoist of claim 8, further comprising:

a variable frequency drive in the form of an electrical board or boards that are connected to the baseplate;

a connection harness that electrically connects the motor, the brake, and an operator pendant control to the variable frequency drive; and a dynamic braking resistor connected to the variable frequency drive.

11. The powered hoist of claim 10, wherein the baseplate is metal and wherein the dynamic braking resistor is connected directly to the baseplate.

12. The powered hoist of claim 1, wherein the motor is one of an electrical motor, a pneumatic motor, or a hydraulic motor.

13. The powered hoist of claim 1, wherein the gearbox is a planetary gearbox.

14. The powered hoist of claim 1, wherein the clutch is one a friction clutch or an electromagnetic clutch.

15. The powered hoist of claim 1, further comprising:

a cover that is connected to the baseplate and the integrated lift/guide assembly and that substantially covers the baseplate, motor, clutch, drive shaft, gearbox and liftwheel and that partially covers the lifting media and the integrated lift/guide assembly.

16. The powered hoist of claim 15, wherein the cover comprises a first cover portion that engages with a first end of the baseplate and a second cover portion that engages with a second and opposing end of the baseplate.

17. The powered hoist of claim 16, wherein the cover further comprises a first end cap that attaches to the first cover portion and a second end cap that attaches to the second cover portion.

18. A powered hoist, comprising:

a baseplate comprising a substantially planar mounting surface having a motor attachment feature and an integrated lift/guide assembly mounting feature formed therein;

a motor connected to the mounting surface of the baseplate via the motor attachment feature;

a clutch connected to the motor and operable to be rotated thereby;

a drive shaft connected to the clutch and operable to be turned by the rotation thereof;

a gearbox having a gearbox input and a gearbox output, the gearbox input being connected to the drive shaft and actuated by the turning thereof;

a liftwheel connected to the gearbox output and operable to be turned thereby responsive to the actuation of the gearbox input;

a lifting media engaged with the liftwheel and operable to be raised or lowered thereby responsive to the turning of the liftwheel; and an integrated lift/guide assembly connected to the mounting surface of the baseplate via the integrated lift/guide assembly mounting feature, the integrated lift/guide assembly comprising:

a lifting media guide that is connected to the baseplate via the integrated lift/guide assembly mounting feature and that is operable to guide the lifting media around the liftwheel as it turns, the liftwheel being inside the lifting media guide;

first and second side plates affixed to opposing sides of the lifting media guide and operable to secure the liftwheel within the lifting media guide; and an upper hook or lug mount that is connected to one or more of the lifting media guide, the first side plate, and the second side plate and is operable to connect the powered hoist to a structural support;

wherein the drive shaft passes from the clutch to the gearbox through an aperture in the first side plate, an axial channel of the liftwheel, and an aperture in the second side plate.

19. A powered hoist, comprising:

a baseplate;

a motor connected to the baseplate;

a clutch connected to the motor and operable to be rotated thereby;

a drive shaft connected to the clutch and operable to be turned by the rotation thereof;

a gearbox having a gearbox input and a gearbox output, the gearbox input being connected to the drive shaft and actuated by the turning thereof;

a liftwheel connected to the gearbox output and operable to be turned thereby responsive to the actuation of the gearbox input;

a lifting media engaged with the liftwheel and operable to be raised or lowered thereby responsive to the turning of the liftwheel;

an integrated lift/guide assembly comprising:

a lifting media guide that is connected to the baseplate and that is operable to guide the lifting media around the liftwheel as it turns, the liftwheel being inside the lifting media guide;

first and second side plates affixed to opposing sides of the lifting media guide and operable to secure the liftwheel within the lifting media guide; and an upper hook or lug mount that is directly connected to the lifting media guide, indirectly connected to the first side plate and the second side plate via at least the lifting media guide, and operable to connect the powered hoist to a structural support;

wherein the drive shaft passes from the clutch to the gearbox through an aperture in the first side plate, an axial channel of the liftwheel, and an aperture in the second side plate, wherein a first end of an axle of the liftwheel is disposed within the aperture in the first side plate, a second end of the axle of the liftwheel is disposed within the aperture in the second side plate, and bearings are disposed between the first end of the axle of the liftwheel and an edge of the aperture in the first side plate and between the second end of the axle of the liftwheel and an edge of the aperture in the second side plate.

20. The powered hoist of claim 19, further comprising:

a cover that is connected to the baseplate and the integrated lift/guide assembly and that substantially covers the baseplate, motor, clutch, drive shaft, gearbox and liftwheel and that partially covers the lifting media and the integrated lift/guide assembly.

* * * * *